US008672185B2

(12) United States Patent
Worthington et al.

(10) Patent No.: US 8,672,185 B2
(45) Date of Patent: Mar. 18, 2014

(54) DISPENSER CAP WITH SELECTABLE RESERVOIRS

(75) Inventors: Brian Glenn Worthington, Dunellen, NJ (US); Lester Greer, Sandpoint, ID (US)

(73) Assignee: Colgate-Palmolive Company, New York, NY (US)

( * ) Notice: Subject to any disclaimer, the term of this patent is extended or adjusted under 35 U.S.C. 154(b) by 311 days.

(21) Appl. No.: 13/034,532

(22) Filed: Feb. 24, 2011

(65) Prior Publication Data

US 2011/0204090 A1 Aug. 25, 2011

Related U.S. Application Data

(60) Provisional application No. 61/307,748, filed on Feb. 24, 2010.

(51) Int. Cl.
*B67D 7/78* (2010.01)

(52) U.S. Cl.
USPC ..... 222/132; 222/134; 222/144.5; 222/145.4; 222/145.5; 222/549; 206/219; 215/6; 220/526; 604/82

(58) Field of Classification Search
USPC ..... 222/132, 134–142, 144, 144.5, 222/145.4–145.6, 549, 562; 206/219–221; 215/6; 220/521–526; 604/82–83
See application file for complete search history.

(56) References Cited

U.S. PATENT DOCUMENTS 679,983 A * 8/1901 O'Neil ..... 425/376.1
749,719 A 1/1904 Clapp (Continued)

FOREIGN PATENT DOCUMENTS

EP 0 993 864 4/2000
EP 1 346 926 9/2003

(Continued)

OTHER PUBLICATIONS

International Search Report in International Application No. PCT/US2011/026095 mailed Jul. 1, 2011.

*Primary Examiner* — Paul R Durand
*Assistant Examiner* — Andrew P Bainbridge
(74) *Attorney, Agent, or Firm* — Judy W. Chung

(57) ABSTRACT

A dispensing cap is disclosed for mixing a primary flowable substance, such as a soap, lotion, or the like, with a small dose of a secondary flowable substance, such as a fragrance. The dispensing cap includes a plurality of reservoirs containing a plurality of secondary flowable substances. Each of the reservoirs is associated with a secondary piston that, when actuated, causes the secondary flowable substance to be expelled from the reservoir into a mixing chamber in the cap, where it is mixed with the primary flowable substance. Upon mixing the two are dispensed together from a dispensing end of the cap. A selector ring is provided to enable the user to select one of the plurality of reservoirs. The selector ring has an actuation flange that aligns with the secondary piston that is associated with the selected reservoir. The selector ring is engaged with the main piston so, as the primary flowable substance is introduced into the mixing chamber via movement of the main piston, the selector ring and flange are pressed down onto the selected secondary piston, which expels a quantity of selected secondary flowable substance into the mixing chamber. The mixing chamber may have mixing vanes or other physical features to enhance mixing of the primary and secondary flowable substances. The cap may have a lockout feature that prevents actuation if the selected reservoir is empty. The cap may also have a visual indicator that informs the user of a level of secondary flowable substance within the secondary reservoir.

15 Claims, 9 Drawing Sheets

(56) References Cited

U.S. PATENT DOCUMENTS

| | | | | |
|---|---|---|---|---|
| 753,453 | A | 3/1904 | Voindrot et al. | |
| 3,110,423 | A * | 11/1963 | Hegedic et al. | 222/135 |
| 3,301,440 | A | 1/1967 | Carpigiani | |
| 4,029,236 | A | 6/1977 | Carson, Jr. et al. | |
| 4,585,149 | A | 4/1986 | Zulauf | |
| 4,726,747 | A | 2/1988 | Skorka | |
| 4,964,541 | A | 10/1990 | Gueret | |
| 5,011,046 | A | 4/1991 | Graf et al. | |
| 5,285,932 | A | 2/1994 | Boudreau | |
| 5,339,990 | A * | 8/1994 | Wilder | 222/135 |
| 5,346,108 | A | 9/1994 | Pasinski | |
| 5,348,392 | A | 9/1994 | Bouquet et al. | |
| 5,409,140 | A | 4/1995 | Camm et al. | |
| 5,636,765 | A | 6/1997 | DeJonge | |
| 5,816,445 | A | 10/1998 | Gardos et al. | |
| 5,954,236 | A | 9/1999 | Virnelson | |
| 6,053,893 | A | 4/2000 | Bucher | |
| 6,241,129 | B1 | 6/2001 | Bonningue et al. | |
| 6,269,837 | B1 | 8/2001 | Arent et al. | |
| 6,315,166 | B1 | 11/2001 | Beck et al. | |
| 6,343,716 | B1 | 2/2002 | Baudin et al. | |
| 6,415,961 | B2 | 7/2002 | Bonningue et al. | |
| 6,484,906 | B2 | 11/2002 | Bonningue et al. | |
| 6,499,900 | B1 | 12/2002 | Brozell | |
| 6,520,380 | B1 * | 2/2003 | Veltrop et al. | 222/135 |
| 6,936,033 | B2 * | 8/2005 | McIntosh et al. | 604/191 |
| 6,997,358 | B2 | 2/2006 | Wass | |
| 7,055,684 | B2 | 6/2006 | Anderson | |
| 7,228,991 | B2 * | 6/2007 | Barraclough | 222/144.5 |
| 7,377,401 | B2 | 5/2008 | Humphrey | |
| 7,448,518 | B2 | 11/2008 | Yue | |
| 7,497,359 | B2 | 3/2009 | Bergin et al. | |
| 2002/0017536 | A1 | 2/2002 | Bonningue et al. | |
| 2003/0146246 | A1 | 8/2003 | Arsenault et al. | |
| 2004/0011830 | A1 | 1/2004 | Kim | |
| 2004/0050881 | A1 | 3/2004 | Deussen | |
| 2004/0094256 | A1 | 5/2004 | Chang | |
| 2005/0029286 | A1 | 2/2005 | Bergin et al. | |
| 2006/0213927 | A1 | 9/2006 | Behar et al. | |
| 2006/0273112 | A1 | 12/2006 | Fuchs | |
| 2007/0023456 | A1 * | 2/2007 | Jalali et al. | 222/391 |
| 2007/0164058 | A1 | 7/2007 | Burkovskiy | |
| 2007/0211563 | A1 | 9/2007 | De Vries | |
| 2007/0228082 | A1 | 10/2007 | Jasper et al. | |
| 2007/0295753 | A1 | 12/2007 | Vangeel et al. | |
| 2008/0290060 | A1 | 11/2008 | Ammann | |
| 2008/0308183 | A1 | 12/2008 | Law | |

FOREIGN PATENT DOCUMENTS

| | | |
|---|---|---|
| NZ | 299090 | 5/1997 |
| RU | 2005130684 | 4/2007 |
| WO | WO 2004/018319 | 3/2004 |
| WO | WO 2005/014427 | 2/2005 |

* cited by examiner

DISPENSER CAP WITH SELECTABLE RESERVOIRS

CROSS-REFERENCE TO RELATED APPLICATIONS

This application claims the benefit of U.S. Provisional Application No. 61/307,748, filed on Feb. 24, 2010. The disclosure of the above application is incorporated herein by reference.

FIELD OF THE INVENTION

The present invention relates to dispensing caps in general, and in particular to a dispensing cap that enables selective addition of a secondary fluid from one of a number of auxiliary reservoirs.

BACKGROUND OF THE INVENTION

There are many flowable packaged substances or products on the market today offering many choices to consumers for personal care, oral care, and home care products. Such products may include without limitation body washes, liquid soap, body lotions, shampoos, conditioners, household cleaners, etc. Products within the same category are often available in a variety of formulations, colors, and/or fragrances adding to the type and number of products available. However, products are often packaged alone in a single container. Thus, if consumers want to experience more than one product at any time, several individual containers or bottles of products must generally be purchased and stored so that the desired product is available when needed. The purchase of many individual separate containers to obtain the variety of products desired may become a costly proposition and cumbersome to store.

Thus, it would be desirable to provide multiple product options within a single convenient container. For example, it would be desirable to enable a user to select from a variety of different fragrance options that could be mixed with, or added to, a basic liquid product such as a body wash or shampoo. A variety of arrangements have been used in the past to provide mixing of fluids during dispensing. Such prior arrangements often include a single flexible container housing separate fluid compartments separated by a wall, where squeezing the container squeezes the separate components from a common nozzle for mixing at the dispensing site. Other arrangements, such as are commonly used for mixing epoxy cements, involve co-dispensing components from separate chambers using a finger-operated piston. Still other devices divide individual components within a single container using a frangible membrane which can be broken during the dispensing operation so that the components can be mixed within the container and dispensed as one.

BRIEF SUMMARY OF THE INVENTION

A device is disclosed for dispensing a primary flowable substance from a main reservoir of a container, where the user can also select a variety of secondary flowable substances from a plurality of additional reservoirs. The device allows the primary and secondary flowable substances to be mixed and dispensed at the same time. In one embodiment, the disclosed device enables a user to select from a variety of different perfumes into a primary liquid body wash or shampoo.

A multi-chamber cap is disclosed for selectively mixing and dispensing a plurality of flowable substances. The cap may comprise a main piston for receiving a primary flowable substance from a primary reservoir, and a secondary reservoir for storing a secondary flowable substance. The cap may further comprise a booster piston associated with the secondary reservoir to dispense the secondary flowable substance. A mixing chamber may be provided for receiving a quantity of the primary flowable substance and a quantity of secondary flowable substance. Accordingly, actuation of the main piston causes a first quantity of the primary flowable substance to be introduced into the mixing chamber, and simultaneously causes a second quantity of the secondary flowable substance to be introduced into the mixing chamber where the primary and secondary flowable substances are at least partially mixed.

A multi-chamber cap is disclosed for selectively mixing and dispensing different flowable substances. The cap may comprise a main piston for receiving a primary flowable substance from a primary reservoir and a plurality of secondary reservoirs for storing a plurality of secondary flowable substances. A plurality of booster pistons may also be provided, each of the plurality of booster pistons associated with a respective one of the plurality of secondary reservoirs to dispense a secondary flowable substance contained in the associated secondary reservoir. A selector may further be provided for selecting one of the plurality of booster pistons to be actuated simultaneously with actuation of the main piston. Accordingly, movement of the main piston from an unactuated position to an actuated position causes a first quantity of the primary flowable substance to be dispensed and causes a second quantity of the selected secondary flowable substance to be dispensed, wherein the primary and secondary flowable substances are at least partially mixed and simultaneously dispensed from a dispensing end of the cap.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

These and other features and advantages of the disclosed device will be more fully disclosed in, or rendered obvious by, the following detailed description of the preferred embodiment of the device, which is to be considered together with the accompanying drawings wherein like numbers refer to like parts, and further wherein.

Figure 1:
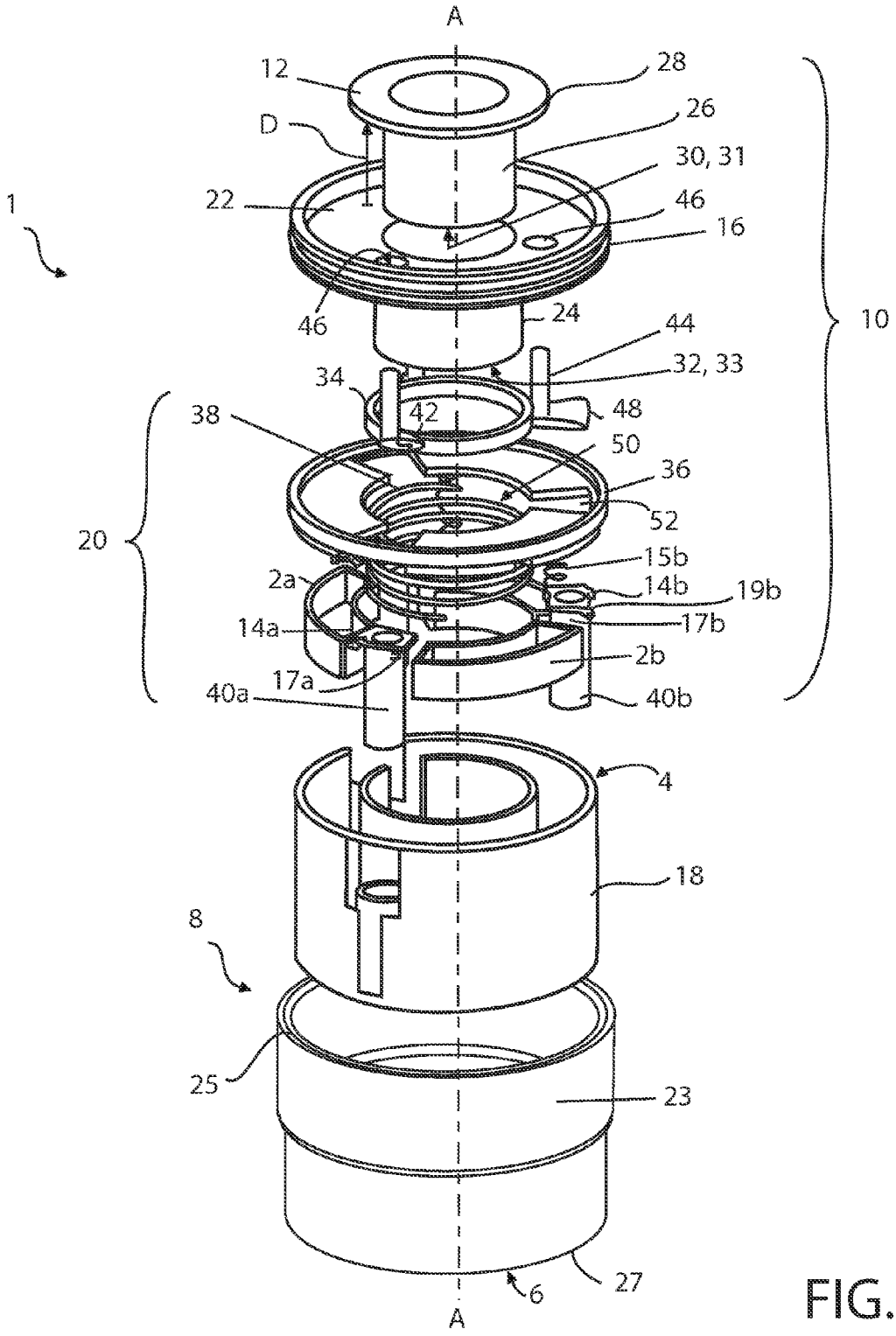
FIG. 1 is an exploded view of a first embodiment of the disclosed dispenser cap.

It will be appreciated that all drawings are schematic in nature and are not actual physical representations of the articles, components or systems described herein, and are further not drawn to scale. The drawings should be interpreted accordingly.

DETAILED DESCRIPTION

This description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 shows a first embodiment of a dispenser cap 1 for providing selective mixing and dispensing of primary and secondary fluid components. The dispenser cap 1 is, in use, mounted to the mouth of a bottle (not shown) that contains a primary fluid, such as body wash, liquid soap, body lotion, shampoo, conditioner, household cleaner, or the like. The dispenser cap 1 itself includes a plurality of secondary reservoirs 2*a*, 2*b*, 2*c*, each of which contains a different secondary material, such as liquid, a free-flowing solid (e.g., beads, powder), fragrance/perfume or dye. The invention is not limited to three reservoirs 2*a*, 2*b*, 2*c*, and could comprise only one secondary reservoir or more than three secondary reservoirs. Operation of the dispenser cap 1 causes a quantity of the selected secondary material to be expelled from its reservoir into a mixing chamber 4 to be mixed with a quantity of the primary fluid. The mixture is then dispensed from a dispensing end 6 of the cap 1, ready for use.

The cap 1 may have a longitudinal axis A-A, and a bottle engaging end 8 disposed at an end of the cap 1 opposite that of the dispensing end 6. The bottle engaging end 8 enables the cap 1 to be mounted to the mouth of a bottle containing a desired primary fluid as previously described. In one embodiment, the bottle engaging end 8 comprises internal threads configured to mate with external threads of a plastic bottle containing the primary fluid. It will be appreciated, however, that any other type of interlocking system, such as a bayonet type connection, can also be used. Alternatively, the bottle engaging end 8 may be heat sealed or otherwise permanently connected to the mouth of the bottle. It will be appreciated that the cap 1 may be provided integral with a bottle, or it can be configured to be fit to a variety of different bottles or containers. For example, the cap 1 may include adjustable locking mechanism such that the locking mechanism can be adjusted to fit the different bottles or containers.

The cap 1 may include a dual-piston arrangement 10 for expelling a quantity of a selected secondary material from one of the reservoirs 2*a-c* into the mixing chamber 4 for mixing with the primary fluid. In addition to mixing the two materials, the dual-piston arrangement 10 also works to dispense the mixed material from the dispensing end 6 of the cap 1.

The dual-piston arrangement 10 may include a main piston 12 and a plurality of booster pistons 14*a-c*, where each of the booster pistons 14*a-c* are associated with a respective reservoir 2*a-c*. The number of booster pistons 14*a-c* is dependent upon the number of secondary reservoirs. There is an equal number of booster pistons 14*a-c* and secondary reservoirs. The main piston 12 may be seated for sliding movement along the longitudinal axis A-A within a piston base 16. The piston base 16 is received within a cylinder 18 that contains the mixing chamber 4. Disposed between the piston base 16 and the cylinder 18 is a reservoir actuation section 20, which is operable to select a reservoir 2*a-c* from which a quantity of secondary material is expelled into the mixing chamber 4. The piston base 16, reservoir actuation section 20 and cylinder 18 may be contained within a cap housing 23. At an end 25, the cap housing 23 includes structure (e.g., threads) for engaging the mouth of a bottle. At an opposite end 27, the cap housing 23 comprises the dispensing end 6 of the cap 1. The end 27 may include an appropriate one-way valve to allow dispensed material to flow out of the cap 1, and to prevent air or other material from flowing back into the cap 1. In one embodiment, the one-way valve comprises a flexible domed-shaped member with a plurality of slits formed therein.

As noted, the main piston 12 slides within the piston base 16 during operation of the device. The piston base 16 has an upper flange portion 22 and a cylindrical lower portion 24 that is sized to receive a cylindrical body portion 26 of the main piston 12. The main piston 12 further has an upper flange portion 28, an underside of which engages the upper flange portion 22 of the piston base 16 when the main piston 12 is fully engaged with the piston base 16. Thus the downward stroke of the main piston 12 is limited by the engagement of the respective upper flange portions 22, 28 of the main piston 12 and the piston base 16. The main piston 12 is normally biased away from the piston base 16 as will be discussed later. Thus, in an initial position, the upper flange portion 28 of the main piston 12 is positioned at a distance "D" from the upper flange portion 22 of the piston base 16. When the device is actuated, primary fluid enters the cylindrical body portion 26 of the main piston 12, forcing the main piston 12 along the longitudinal axis A-A, into further engagement with the piston base 16. Actuation can be via any of a variety of methods such as squeezing, or by a mechanical device energized by springs, motors or the like. Corresponding openings 30, 32 disposed in the respective front walls 31, 33 of the cylindrical body portion 26 of the main piston 12 and the cylindrical lower portion 24 of the piston base 16 allows some of the primary fluid to pass through into the mixing chamber 4, to be mixed with the secondary material. Suitable one-way valves may be provided in openings 30, 32 to enable a desired single direction flow of primary fluid through the main piston 12 and the piston base 16. A non-limiting list of such valves include elastomeric flappers, ball check valves, a septum with a slit or slits, and the like.

In addition to admitting primary fluid into the mixing chamber 4, the main piston 12 also engages the reservoir actuation section 20 to selectively actuate the booster pistons 14*a-c* to force a selected secondary material into the mixing chamber 4. The reservoir actuation section 20 may include a rotatable push-ring assembly 34, a piston selection ring 36, a push-ring spring 38, secondary material reservoirs 2*a-c*, and booster piston cylinders 40*a-c* that receive the booster pistons 14*a-c*.

The rotatable push-ring assembly 34 includes a ring structure 42, around which are positioned a plurality of upwardly protruding guides 44 configured to engage the upper flange portion 28 of the main piston 12. The guides 44 are received within correspondingly-shaped holes 46 in the upper flange portion 22 of the piston base 16 so that the push-ring assembly 34 resides below the piston base 16, with the guides 44 protruding above the piston base 16. The push-ring assembly 34 further includes a radially-disposed flange 48 which is configured to engage a selected one of the booster pistons 14*a-c* when the flange is aligned with the selected booster piston 14*a-c*. The push-ring assembly 34 may be engaged with a ring (not shown) which is accessible from the outside of the cap housing 23 to enable a user to manually rotate the assembly 34 to select a desired reservoir 2*a-c* for mixing with the primary fluid.

The piston selection ring 36 is a disc-shaped member having a hole 50 in the center that is sized to receive the cylindrical lower portion 24 of the piston base 16. The piston selection ring 36 also has a plurality of radial openings 52 sized and shaped to allow the flange 48 of the push-ring assembly 34 to pass through the ring 36 when the flange 48 is aligned with one of the openings 52. The openings 52 are positioned to overlie one of the booster pistons 14*a-c* so that a piston 14*a-c* can be actuated by rotating the push-ring assembly 34 so that the flange 48 overlies a selected opening 52.

The rotatable push-ring assembly 34 is biased toward the piston base 16 by the spring 38. This biasing forces the guides 44 to move within holes 46 to press on the upper flange portion 28 of the main piston 12, separating the upper flange portion 28 of the main piston 12 from the upper flange portion 22 of the piston base 16.

When the main piston 12 is pressed down (against the force of spring 38), the upper flange portion 28 presses against the guides 44 which causes the flange 48 of the push-ring assembly 34 to move down through a corresponding opening 52 in the piston selection ring 36. Continued downward movement of the push-ring assembly 34 causes flange 48 to engage and actuate the selected booster piston 14*a-c*, which forces secondary material in the associated reservoir 2*a-c* into the mixing chamber 4.

As previously noted, each of the booster pistons 14*a-c* is associated with a respective one of the secondary material reservoirs 2*a-c*. In the illustrated embodiment, the booster pistons 14*a-c* and reservoirs 2*a-c* are disposed beneath the push-ring assembly 34 and the piston selection ring 36. The pistons 14*a-c* and reservoirs 2*a-c* may be evenly spaced about the circumference of the cylindrical space defined by the cylinder 18. The reservoirs 2*a-c* are in fluid communication with the associated booster piston 14*a-c* so that a downward stroke of the piston causes material from the reservoir 2*a-c* to be expelled into the mixing chamber 4. In one embodiment, the reservoirs 2*a-c* are connected to their associated booster piston 14*a-c* via small tube or other conduit disposed between the two.

For clarity of illustration, the reservoirs 2*a-c* are shown in FIG. 1 as having open tops. It will be appreciated, however, that closed tops 3*a-c* (see FIGS. 2A-2C)) will be provided for each of the reservoirs 2*a-c*. In one embodiment, the closed tops 3*a-c* will be fitted to the reservoirs 2*a-c* to enable the tops to slide down within the reservoirs 2*a-c* as fluid is expelled. The sliding top arrangement minimizes or eliminates the need to provide an air path to the reservoirs 2*a-c* to facilitate movement of the fluid out of the reservoirs 2*a-c*. Individual springs 15*a-c* may be positioned between the piston selection ring 36 and the sliding tops 3*a-c* to bias the tops 3*a-c* downward into engagement with the fluid in the reservoirs 2*a-c*. Thus, as fluid is expelled from a reservoir 2*a-c*, the associated spring 15*a-c* will press the top 3*a-c* down into the reservoir 2*a-c* to automatically maintain the top 3*a-c* even with the top of the fluid in the reservoir 2*a-c*.

As an alternative to, or in addition to, the sliding top arrangement, air paths may be provided to the reservoirs 2*a-c* to facilitation expulsion of fluid upon actuation of the pistons 14*a-c*.

In one embodiment, fluid from the reservoir 2*a-c* is expelled from the bottom of the associated booster piston 14*a-c* and into the mixing chamber 4 upon actuation of the piston 14*a-c*. In another embodiment, fluid is expelled into the mixing chamber 4 direction from the reservoir 2*a-c* as the reservoir 2*a-c* is pressurized by an actuated piston 14*a-c*. In either case, an appropriate one-way valve would be disposed between the piston 14*a-c* and the mixing chamber 4, or between the reservoir 2*a-c* and the mixing chamber 4. In addition, a one-way valve may be disposed between the reservoir 2*a-c* and associated piston 14*a-c* to control movement of fluid therebetween. A non-limiting list of suitable one-way valves includes elastomeric flappers, ball check valves, a septum with a slit or slits, and the like.

Each of the booster pistons 14*a-c* may be provided with a spring 17*a-c* positioned beneath an upper rim 19*a-c* of the piston 14*a-c* and the associated cylinder 40*a-c*. These springs 17*a-c* are compressed when the flange 48 of the push-ring assembly 34 engages the selected booster piston 14*a-c* to move it downward within the associated booster cylinder 40*a-c*. After actuation, as the push-ring assembly 34 flange 48 disengages from the booster piston 14*a-c*, the spring 17*a-c* causes the booster piston 14*a-c* to move upward within the associated cylinder 40*a-c* so that the piston 14*a-c* is once again in position to be actuated again. In one embodiment, this upward movement may cause fluid to be drawn from the reservoir 2*a-c* into the cylinder 40*a-c* via a syringe-like effect. In this way, the piston 14*a-c* is "charged" and ready for further dispensing.

Figure 2A:
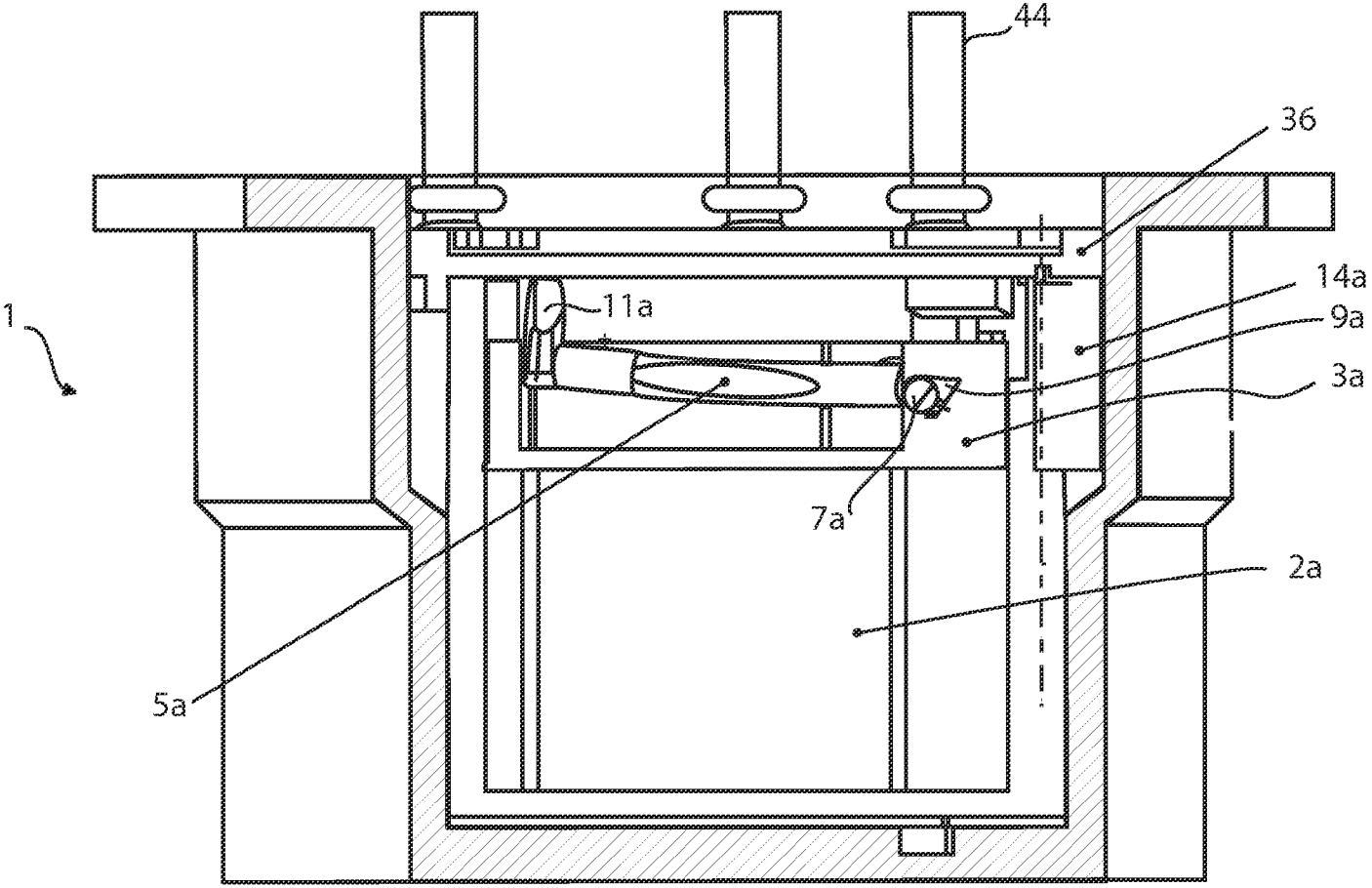
FIGS. 2A-2C are cutaway views of the cap of FIG. 1 showing an exemplary lock-out feature.
Figure 2B:
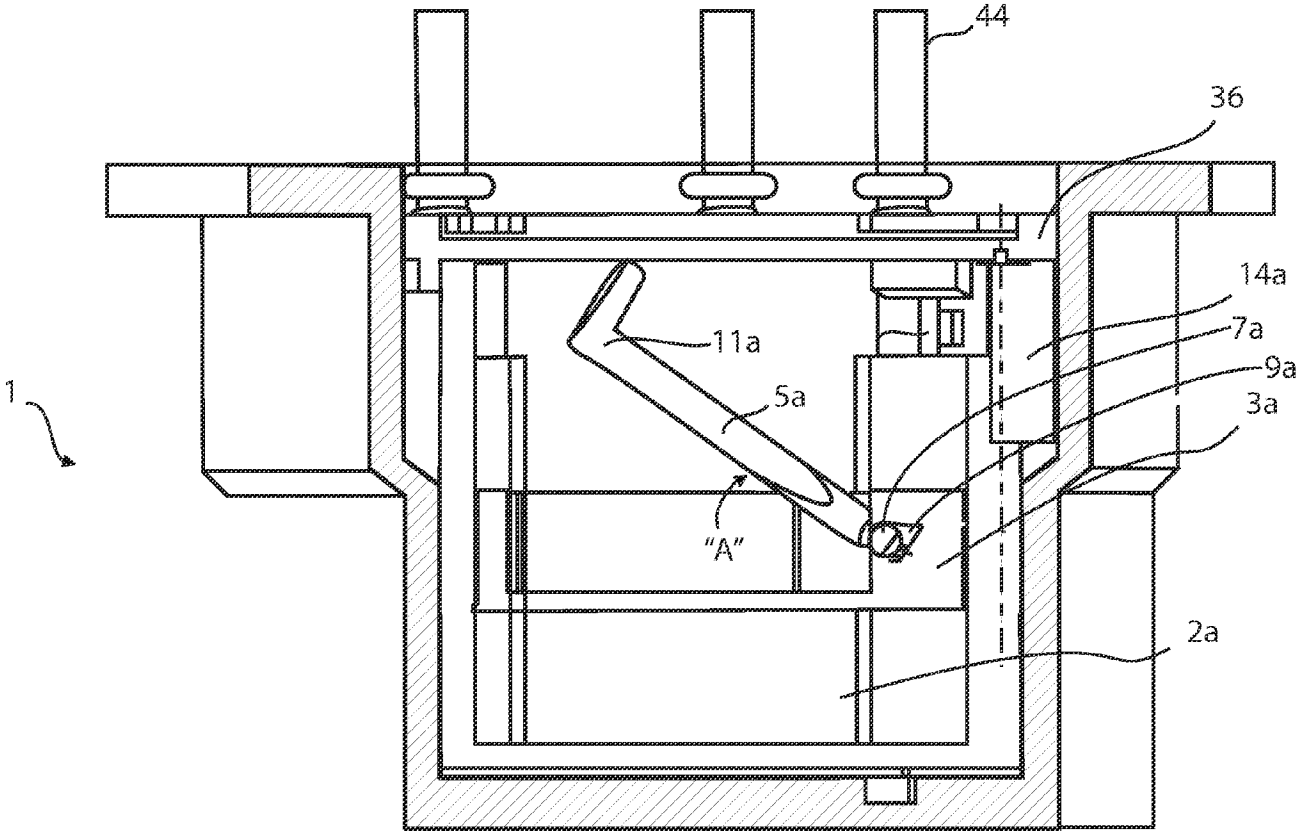
Figure 2C:
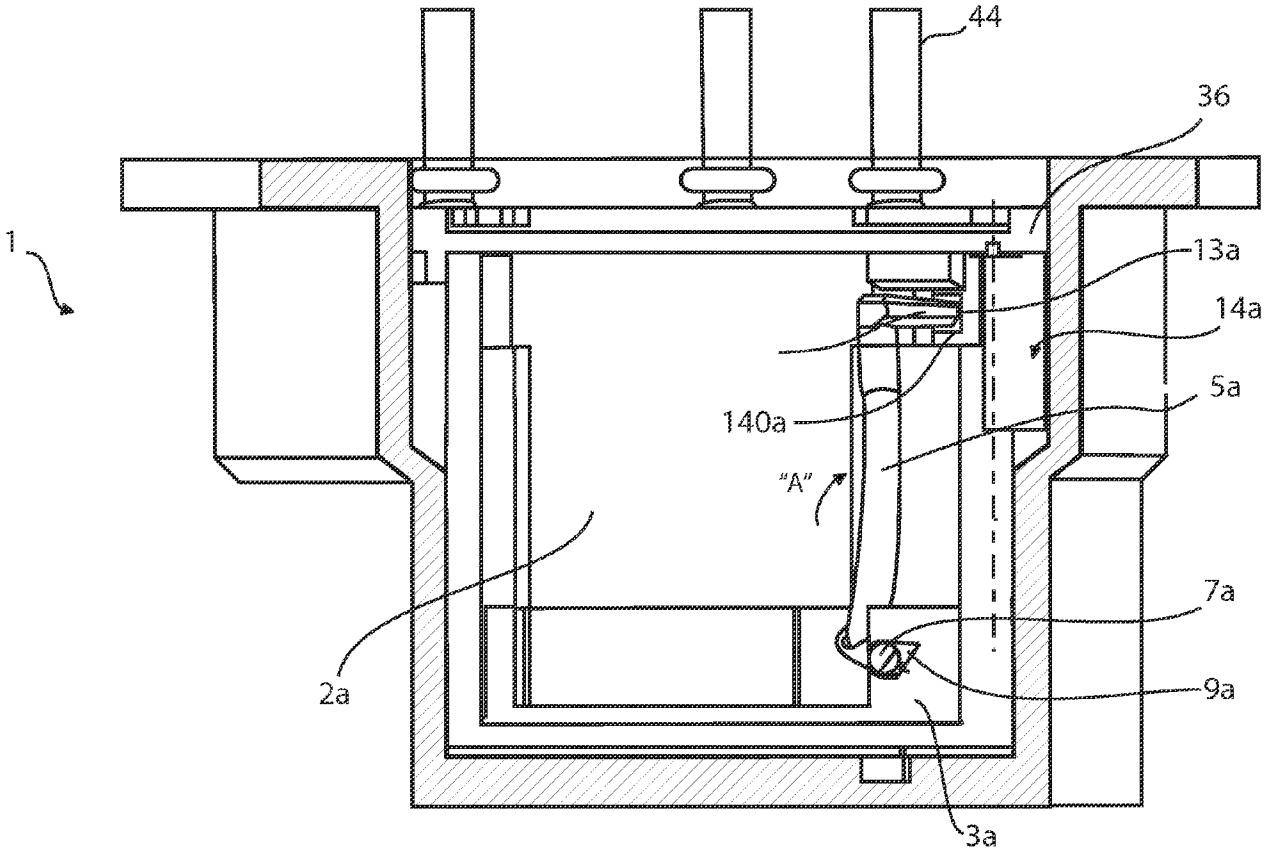

Referring to FIGS. 2A-2C, an exemplary lock-out feature is shown. This feature prevents operation of the cap 1 where the user selects an empty reservoir 2*a-c*. Such a feature may be desirable so that the user will not be able to operate the cap 1 with an empty reservoir 2*a-c* selected. FIGS. 2A-2C show a cross-section of reservoir 2*a*, though it will be appreciated that similar arrangement will be provided for the other reservoirs 2*b*, 2*c*. As previously noted, the reservoir 2*a* may have a top 3*a* that is slidable with respect to the reservoir 2*a* so that, as fluid is expelled from the reservoir 2*a*, the top 3*a* moves downward to remain in contact with the upper surface of the fluid. A rotatable arm 5*a* has a first end with a lateral projection 7*a* positioned within a lateral opening 9*a* in the top 3*a* so that the arm 5*a* is pivotable with respect to the top 3*a*. A second end 11*a* of the rotatable min 5*a* contacts the piston selection ring 36. Although not shown, a spring is provided to bias the second end 11*a* of the arm 5*a* into engagement with the piston selection ring 36. FIG. 2A shows a position of the cap 1 in which the reservoir 2*a* is full of the secondary fluid, such that the top 3*a* is in an uppermost position with respect to the reservoir 2*a*. In this condition, the arm 5*a* is generally parallel to the top 3*a* and the piston selection ring 36. FIG. 2B shows a position of the cap 1 in which the reservoir 2*a* has been partially depleted of the secondary fluid. In this position, the top 3*a* has moved downward within the reservoir 2*a*, and the spring has caused the arm 5*a* to rotate in the direction of arrow "A" about the lateral projection 7*a* to maintain the second end 11*a* of the arm in contact with the piston selection ring 36. FIG. 2C shows a position of the cap 1 in which the reservoir 2*a* is substantially or completely depleted of the secondary fluid. In this position, the top 3*a* contacts the bottom of the reservoir 2*a*, and the spring has caused the arm 5*a* to rotate further in the direction of arrow "A" such that the arm 5*a* is generally perpendicular to the top 3*a* and the piston selection ring 36. In this position, a tip 13*a* of the arm engages a recess 140*a* in the booster piston 14*a*. Once the tip 13*a* engages the recess 140*a*, the arm 5*a* locks the piston 14*a* and prevents it from moving downward, which thereby prevents operation of the cap 1 so long as the empty reservoir 2*a* is selected. The cap 1 may operate with another reservoir (e.g., 2*b-c*) in which there remains a secondary flowable substance.

Figure 3C:
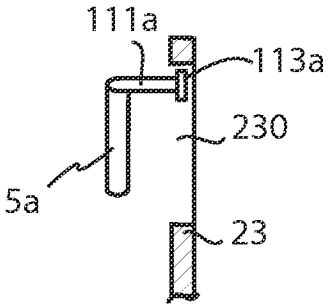
FIGS. 3A-3C are detail views of an exemplary level indicator system for use with the cap of FIG. 1.
Figure 3B:
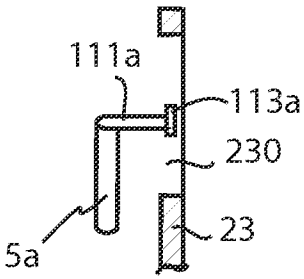
Figure 3A:
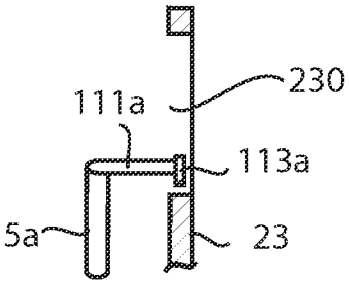
Figure 4:
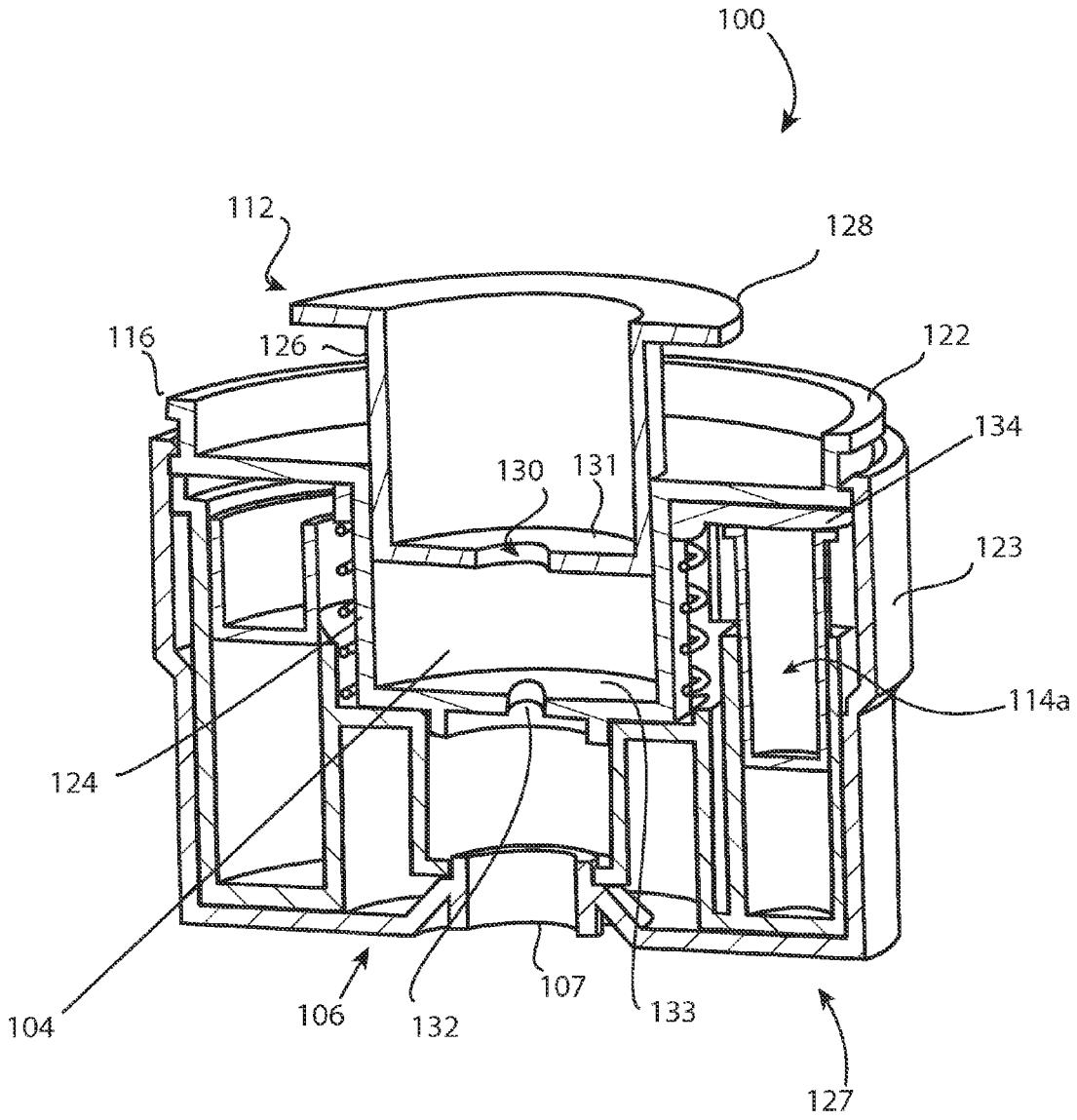
FIG. 4 is a cutaway view of a second embodiment of the disclosed dispenser cap.

In one embodiment, a window indicator may be provided in one side of the cap 1 to provide a visual indication regarding the fill level of a particular reservoir 2*a-c*. In one embodiment, (shown in FIGS. 3A-3C) the arm 5*a* may comprise a further lateral extension 111*a* positioned at the second end 11*a* that engages a slidable member 113*a* received within a corresponding recess 230 in the side of the cap housing 23. The slidable member 113*a* may have a particular color or shading so that its position is noticeable from outside the cap 1 through the recess 230. Thus, as the arm 5*a* rotates (i.e., as the reservoir 2*a* becomes depleted), the slidable member 113*a* moves within the recess 230, causing a color or shading change that corresponds to the position of the top 3*a*. Because this color or shading change can be seen from the outside of the cap 1, the user can instantly know whether a particular reservoir is depleted.

The mixing chamber 4 may have features that facilitate or enhance mixing of the primary and secondary fluids to ensure that a final product is dispensed from dispensing end 6 of the cap 1. A non-limiting list of such features includes mixing vanes, staggered screens, a venturi, a tortured flow path, folding or blending paddles, flow splitting for simultaneous multidirectional movement of fluids, a cross-mounted cylinder with protuberances, and the like. Selection of a particular mixing arrangement depends on the amount of mixing desired for a particular application.

In operation, the user selects one of the reservoirs 2*a-c* containing a desired secondary material to add to the primary fluid in the bottle. This is done by manually rotating a ring or other grippable member to move the rotatable piston ring 34 such that the flange 48 overlies a desired radial opening 52 in the piston selection ring 36. Once the desired reservoir 2*a-c* is selected, the user squeezes the bottle, forcing primary fluid into the cylindrical portion 26 of the main piston 12. The primary fluid presses against the front wall 31 of the main piston 12, which moves the main piston 12 within the cylindrical portion 24 of the piston base 16 along the longitudinal axis A-A. As the main piston 12 moves within the piston base 16, a portion of the primary fluid passes through the holes 30, 32 in the piston 12 and base 16, and enters the mixing chamber 4. In addition, as main piston 12 moves, guides 44 of the push-ring assembly 34 are forced downward as a result of their engagement with the upper flange portion 28 of the main piston 12. As the push-ring assembly 34 moves downward, radial flange 48 engages the booster piston 14*a-c* associated with the user-selected reservoir 2*a-c*. As main piston 12 continues its movement, the booster piston 14*a-c* forces secondary material contained in the selected reservoir 2*a-c* into the mixing chamber 4, where the primary fluid and the secondary material are mixed and dispensed from the dispensing end 6 of the cap 1.

Once the user ceases squeezing the bottle, the spring 38 urges the push-ring assembly 34 back to its original position, and with it the guides 44 force the main piston 12 back to its original position. The device is once again in a position to be actuated.

In one embodiment, the pistons 14*a-c* are sized to provide a 10:1 volumetric ratio of primary fluid to secondary material. Due to the above-described arrangement of components, this volumetric ratio will be maintained regardless of the amount of movement of the main piston 12.

It will be appreciated that although the illustrated embodiment includes three separate reservoirs 2*a-c*, any appropriate number of individual reservoirs and pistons can be used to provide a desired variety of dosing options.

Referring now to FIGS. 4-7, a second embodiment of the disclosed dispensing cap 100 is shown. As with the embodiment described in relation to FIG. 1, cap 100 provides selective mixing and dispensing of primary and secondary fluid components in a predetermined ratio. The dispenser cap 100 has a bottle engaging end 108 is configured to be mounted to the mouth of a bottle in a manner similar to that described in relation to the embodiment of FIG. 1. Cap 100 also includes a plurality of secondary reservoirs 102*a-c*, each of which contains a different secondary material, such as liquid, a free-flowing solid (e.g., beads, powder), fragrance or die. Each of the secondary reservoirs is associated with a booster piston 114*a-c* that is operable to expel a quantity of the selected secondary material into a mixing chamber 104 to be mixed with a quantity of the primary fluid. The mixture is dispensed from a dispensing end 106 of the cap 1.

Cap 100 comprises a main piston 112 and a piston base 116, each having an upper flange portion 128, 122 and a lower cylindrical portion 126, 124. The lower cylindrical portions 126, 124 each has a front wall 131, 133 with a respective opening 130, 132 for admitting primary fluid from the bottle into the mixing chamber 104 when the bottle is squeezed. Suitable one-way valves may be provided in openings 130, 132 to enable a desired single direction flow of primary fluid through the main piston 112 and piston base 116. A non-limiting list of such valves include elastomeric flappers, ball check valves, a septum with a slit or slits, and the like.

The lower cylindrical portion 124 of the piston base 116 comprises a mixing chamber 104 that receives primary fluid via opening 130 in the main piston 112 and mixes it with secondary fluid expelled from the booster pistons 114*a-c*. The mixing chamber 104 may have features that facilitate or enhance mixing of the primary and secondary fluids to ensure that a final product is dispensed from dispensing end 106 of the cap 100. A non-limiting list of such features includes mixing vanes, staggered screens, a venturi, a tortured flow path, folding or blending paddles, flow splitting for simultaneous multidirectional movement of fluids, a cross-mounted cylinder with protuberances, and the like. Selection of a particular mixing arrangement depends on the amount of mixing desired for a particular application.

Piston base 116 is received within a cylinder 118. Disposed between the piston base 116 and the cylinder 118 is a reservoir actuation section 120, which is operable by the user to select a reservoir 102*a-c* from which a quantity of secondary material is expelled into the mixing chamber 104. The piston base 116, reservoir actuation section 120 and cylinder 118 are disposed within a cap housing 123. At one end 125, the cap housing 123 includes structure (e.g., threads) for engaging the mouth of a bottle as previously noted. At an opposite end 127, the cap housing comprises the dispensing end 106 of the cap 1. The dispensing end 106 may include a one-way valve 107 that enables the dispensed material to exit the cap 1 but which prevents materials from outside the cap entering the mixing chamber 104. A one-way valve may also be disposed within or adjacent to the opening 132 in the front wall 133 of the piston base 116. These one-way valves may include elastomeric flappers, ball check valves, a septum with slit or slits, and the like.

Figure 6:
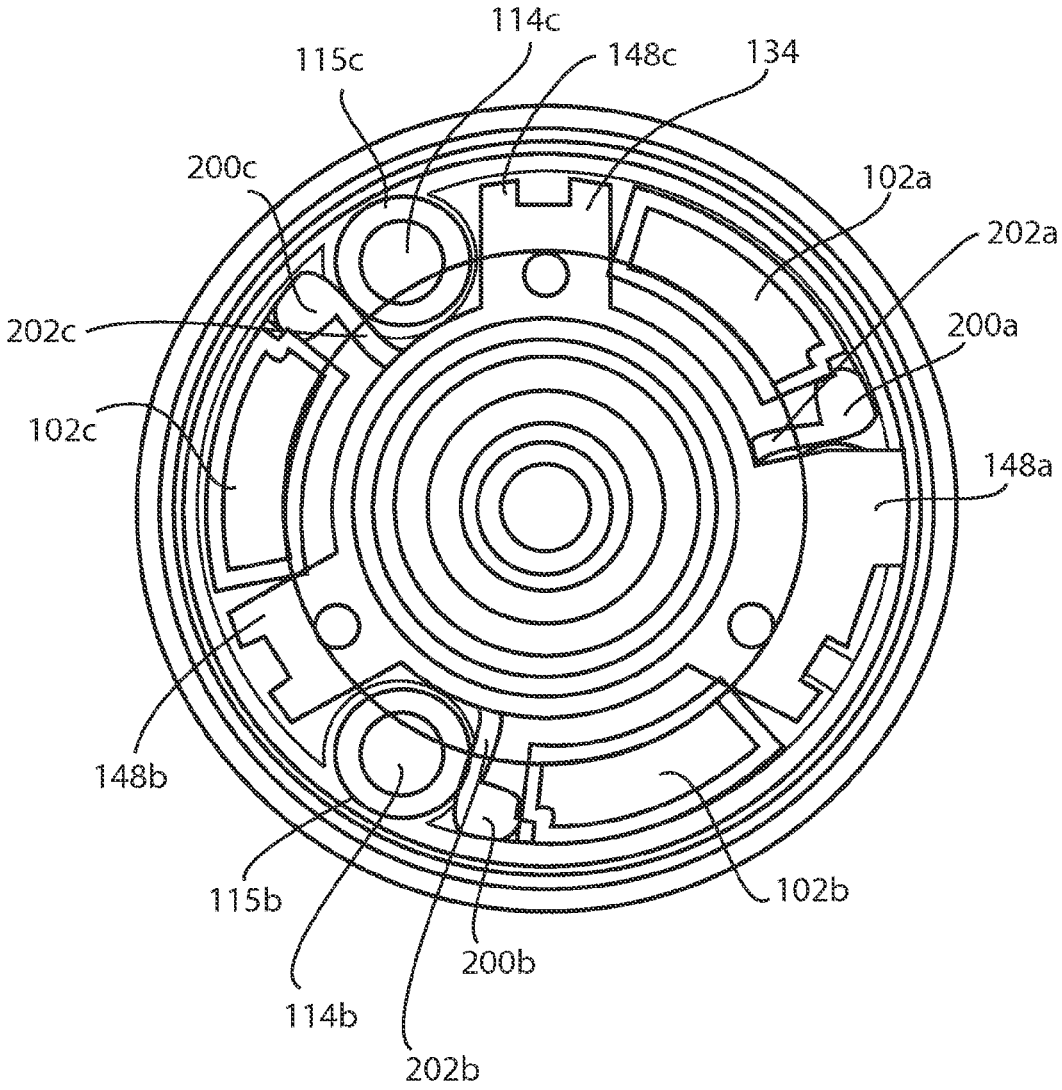
FIG. 6 is a top view of the dispenser cap of FIG. 4.

The reservoir activation section 120 of cap 100 includes a rotatable push-ring assembly 134 that comprises a ring structure 142, around which are positioned a plurality of upwardly protruding guides 144 configured to engage the upper flange portion 128 of the main piston 112. The guides 144 are received within correspondingly-shaped holes 146 in the upper flange portion 122 of the piston base 116 so that the push-ring assembly 134 resides below the piston base 116, while the guides 144 protrude above the piston base 116. The push-ring assembly 134 further includes a plurality of radially-disposed flanges 148*a-c*. One of the flanges 148*a* is wider than the other flanges 148*b, c*, which enables the flange 148*a* (termed the "activation flange") to engage a selected one of the booster pistons 114*a-c* when the ring 142 and flange 148*a* are pressed downward. (As can be seen in FIG. 6, the activation flange 148*a* covers booster piston 114*a*, while flanges 148*b* and 148*c* do not). The push-ring assembly 134 may be engaged with a ring (not shown) accessible from the outside of the cap housing 123 to enable a user to manually rotate the assembly 134 to select a desired reservoir 102*a-c* for mixing with the primary fluid.

Figure 7:
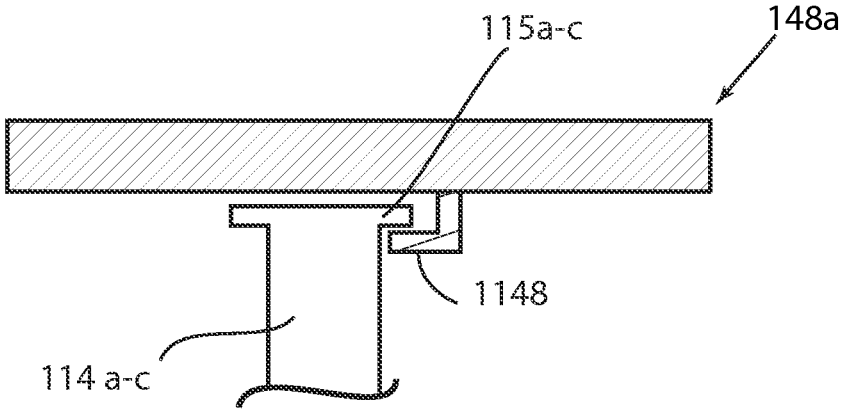
FIG. 7 is a partial side view of a piston-engaging flange element for use with the cap of FIGS. 4-6.

In the illustrated embodiment, the activation flange 148*a* is positioned over booster piston 114*a*, though the push-ring assembly 134 can be rotated so that the activation flange 148*a* is positioned over any one of the booster pistons 114*a-c*. Thus, when the main piston 112 is moved downward (in a manner previously described in relation to the FIG. 1 embodiment), the upper flange portion 128 of the main piston 112 presses down on the guides 144, which press the activation flange 148*a* down into engagement with the booster piston 114*a*. This causes the booster piston 114*a* to expel fluid from the associated reservoir 102*a* into the mixing chamber 104. A spring (not shown) is positioned between the main piston 112 and the piston base 116. Actuation of the cap 1 causes the spring to compress, so that after the main piston 112 is moved downward to expel a quantity of primary fluid and secondary fluid into the mixing chamber 104, the spring pushes the main piston 112 back upward to its original position. This action of the spring also causes the selected booster piston 114*a-c* to be drawn upwards via positive engagement of the piston 114*a-c* with the activation flange 148*a*. As shown in FIG. 7, this is accomplished by the use of an engaging lip 1148 disposed on the bottom surface of the activation flange 148*a*. As the push ring assembly 136 is rotated, the lip 1148 slides into contact with the circumferential lip 115*a-c* of the selected booster piston 114*a*, thus providing the necessary engagement of the flange 148*a* and piston 114*a-c* that enables the flange to retract the piston to its original position after the device has been actuated. In this way, the cap 1 is ready to be actuated once again.

The booster pistons 114*a-c* and reservoirs 102*a-c* may be interconnected to each other, and may operate in a manner similar to the pistons 14*a-c* and reservoirs 2*a-c* described in relation to the embodiment of FIGS. 1-3C. Thus, secondary fluid may be expelled from the piston 114*a-c*, or from the reservoir 102*a-c* itself, directly into the mixing chamber 104. A suitable one-way valve (e.g., flapper valve, ball check valve) may be incorporated at the outlet to the mixing chamber 104 to prevent backflow of secondary fluid into the reservoir 102*a-c* and/or booster piston 114*a-c*. Further, the reservoirs 102*a-c* may have slidable tops (similar to tops 3*a-c*) and/or air vent connections to facilitate expulsion of secondary fluid from the reservoir 102*a-c* during use.

Figure 5:
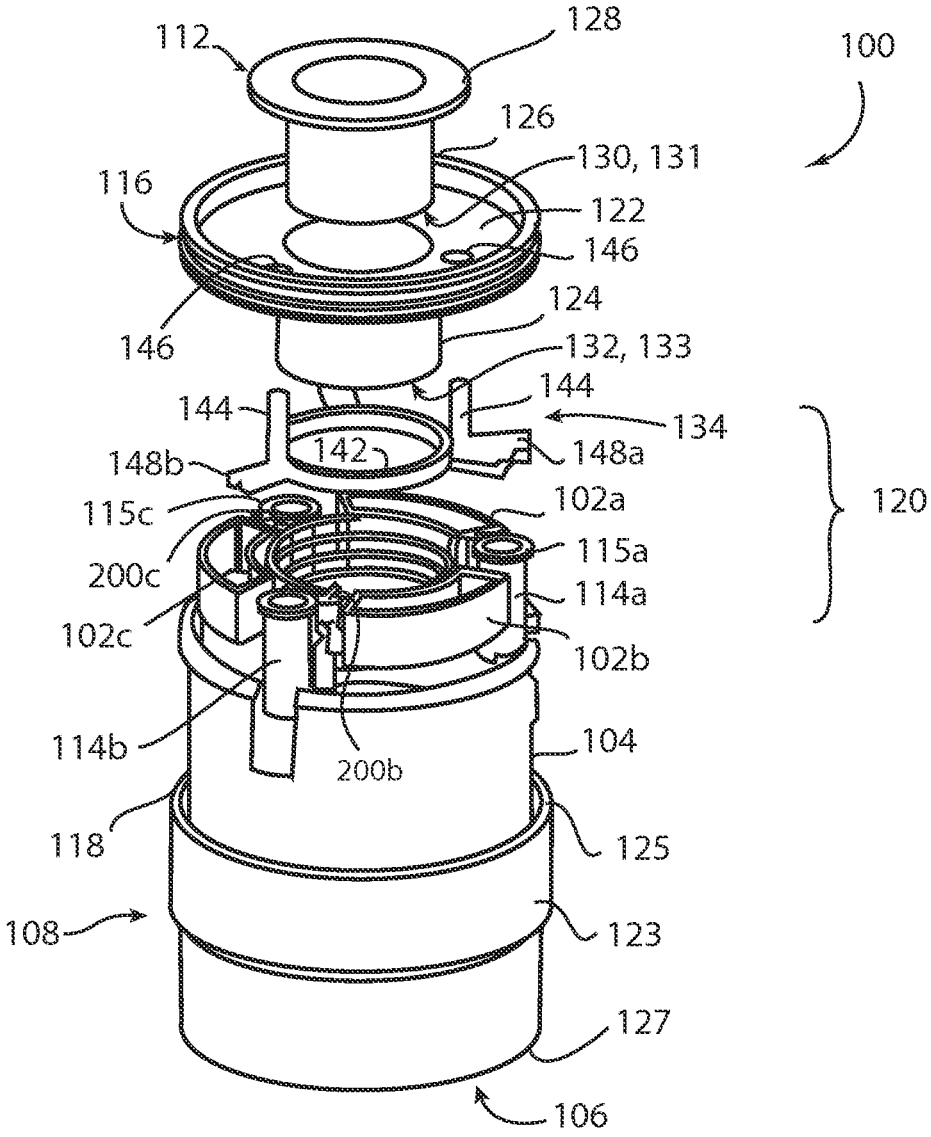
FIG. 5 is an exploded view of the dispenser cap of FIG. 4.

After repeated uses of the cap 100, one or more of the reservoirs 102*a-c* may become depleted of the associated secondary material. Thus, it may be desirable to provide a lock-out feature that prevents further selection of the depleted reservoir. FIGS. 4-7 show a lock-out feature comprising a plurality of lock-out pawls 200*a-c*, each of the pawls being associated with one of the reservoirs 102*a-c*. As shown in FIG. 5, each of the booster pistons 114*a-c* has a circumferential lip 115*a-c* positioned at a top surface of the piston 114*a-c* (i.e., where the piston 114*a-c* contacts the activation flange 148*a*). When one of the reservoirs 102*a-c* is depleted, the associated lockout pawl 200*a-c* can be rotated so that a tip 202*a-c* of the pawl 200*a-c* lodges just below the flange 148*a-c* of the associated booster piston 114*a-c*. Thus positioned, the pawl tip 202*a-c* prevents the booster piston 114*a-c* from moving downward. Rotation of the lockout pawl 200*a-c* can be via engagement with an arm whose structure and operation are the same or similar to that of rotatable arm 5*a* previously described in relation to FIGS. 2A-2C.

In addition to, or as an alternative to, a lock-out feature, the cap 100 may include a visible indicator that shows a user that a particular reservoir is empty. In one embodiment this may include a window indicator feature that is the same or similar to that described in relation to the embodiment of FIGS. 1-3C.

Similar to the embodiment of FIG. 1, the pistons 114*a-c* of cap 100 are sized to provide a 10:1 volumetric ratio of primary fluid to secondary material. Due to the above-described arrangement of components, this volumetric ratio will be maintained regardless of the amount of movement of the main piston 112. In addition, although the illustrated embodiment includes three separate reservoirs 102*a-c*, any appropriate number of individual reservoirs and pistons can be used to provide a desired variety of dosing options.

In each of the examples described above, the dispensing ratios can be determined by variation of nozzle aperture sizes, size of pre-dose chambers and flexibility of the reservoirs or length of action of the piston mechanisms. Any ratio of primary fluid to secondary fluid can therefore be achieved but it is not anticipated that a ratio of more than 50% secondary fluid would be desirable. It is also desirable that the secondary reservoirs would empty at the same rate as the primary reservoir such that there should preferably be an equal number of doses in the combined volume of the secondary reservoirs to the number of doses in the primary reservoir. For example, a unit with a primary reservoir of 300 ml may dispense 5 ml of primary fluid on each use and 0.5 ml of secondary fluid. Given that there are 60 doses of primary fluid in the primary reservoir, for a device with three secondary reservoirs, each reservoir should contain 10 ml to allow for 20 doses per reservoir. A preferred ratio of primary fluid:secondary fluid would be in the range of 98:2 to 80:20.

As used throughout, ranges are used as shorthand for describing each and every value that is within the range. Any value within the range can be selected as the terminus of the range.

What is claimed is:

1. A multi-chamber cap for selectively mixing and dispensing a plurality of flowable substances, comprising:

a main piston for receiving a primary flowable substance from a primary reservoir;

a mixing chamber for receiving a quantity of the primary flowable substance and a quantity of the secondary flowable substance;

a plurality of secondary reservoirs for storing a plurality of secondary flowable substances;

a plurality of booster pistons, each of the plurality of booster pistons being associated with a respective one of the plurality of secondary reservoirs, each of the plurality of booster pistons for dispensing the secondary flowable substance contained in the respective one of the plurality of secondary reservoirs; and a selector for selecting one of the plurality of booster pistons to be actuated upon actuation of the main piston;

wherein actuation of the main piston causes a first quantity of the primary flowable substance to be introduced into the mixing chamber, and simultaneously causes a second quantity of a secondary flowable substance from a selected secondary reservoir to be introduced into the mixing chamber where the primary and secondary flowable substances are at least partially mixed, and wherein the selector comprises a rotatable ring having an activation flange and at least one guide arm positioned for contact with the main piston, the activation flange further being positionable adjacent one of the plurality of booster pistons such that when the main piston is actuated, the at least one guide arm engages the main piston causing the activation flange to actuate the selected booster piston.

2. The multi-chamber cap of claim 1, wherein actuation of the main piston further causes the mixed primary and secondary flowable substances to be dispensed from a dispensing end of the cap.

3. The multi-chamber cap of claim 1, wherein each of the plurality of secondary reservoirs has a movable top that slides with respect to the associated reservoir and engages a top surface of the secondary flowable substance contained therein.

4. The multi-chamber cap of claim 3, further comprising a secondary reservoir level indicator including a sliding member disposed in a portion of a housing of the cap, the sliding member being movable with the associated movable top, wherein at least a portion of the sliding member being viewable by a user from an outside of the housing to display a fluid level in the associated secondary reservoir.

5. The multi-chamber cap of claim 3, wherein each of the plurality of secondary reservoirs further comprises a lock-out feature including a rotatable locking arm engaged with the movable top, and wherein a spring is associated with the rotatable arm so that as the movable top bottoms out in the associated secondary reservoir, the rotatable locking arm engages a recess in the associated booster piston to prevent further movement of the booster piston.

6. The multi-chamber cap of claim 3, wherein each of the plurality of secondary reservoirs further comprises a lock-out feature including a rotatable pawl, and wherein when the movable top bottoms out in the associated secondary reservoir, the rotatable pawl rotates to interfere with an upper lip portion of the associated booster piston to prevent further movement of the booster piston.

7. The multi-chamber cap of claim 1, further comprising a piston base and a spring disposed between the main piston and the piston base such that when the cap is actuated, the primary flowable substance from the primary reservoir causes the main piston to move from an un-actuated position to an actuated position, compressing the spring.

8. The multi-chamber cap of claim 7, wherein the spring biases the main piston to the un-actuated position.

9. The multi-chamber cap of claim 7, wherein a flange portion of the piston base is positioned between the main piston and the rotatable ring, and the at least one guide arm is disposed through an opening in the flange portion.

10. A multi-chamber cap for selectively mixing and dispensing different flowable substances, comprising:

a main piston for receiving a primary flowable substance from a primary reservoir and dispensing it to a mixing chamber in the housing;

a plurality of secondary reservoirs for storing a plurality of secondary flowable substances;

a plurality of booster pistons, each of the plurality of booster pistons associated with a respective one of the plurality of secondary reservoirs for dispensing a secondary flowable substance contained in the associated secondary reservoir; and a selector for selecting one of the plurality of booster pistons to be actuated simultaneously with actuation of the main piston;

wherein movement of the main piston from an unactuated position to an actuated position causes a first quantity of the primary flowable substance to be dispensed, and causes a second quantity of the selected secondary flowable substance to be dispensed, wherein the primary and secondary flowable substances are at least partially mixed and dispensed from a dispensing end, and wherein each of the plurality of secondary reservoirs further comprises a lock-out feature including a rotatable locking arm engaged with the movable top, and wherein a spring is associated with the rotatable arm so that as the movable top bottoms out in the associated secondary reservoir, the rotatable locking arm engages a recess in the associated booster piston to prevent further movement of the booster piston.

11. The multi-chamber cap of claim 10, wherein the selector comprises a rotatable ring having an activation flange and a guide arm positioned to contact the main piston, the activation flange further being selectively positionable over one of the plurality of booster pistons so that when the main piston is actuated, the main piston engages the guide arm to move the rotatable ring so that the activation flange actuates the selected booster piston.

12. The multi-chamber cap of claim 10, further comprising a piston base and a spring disposed between main piston and the piston base, the spring positioned to bias the main piston away from the piston base.

13. The multi-chamber cap of claim 10, further comprising a booster spring disposed between each of the booster pistons and an associated booster cylinder to bias the booster piston away from the associated booster cylinder.

14. The multi-chamber cap of claim 10, wherein each of the plurality of secondary reservoirs has a movable top that slides with respect to the associated reservoir to engage a top surface of the secondary flowable substance contained therein.

15. The multi-chamber cap of claim 14, further comprising a secondary reservoir level indicator including a sliding member disposed in a recess in a housing of the cap, the sliding member being movable with the associated movable top, wherein at least a portion of the sliding member being viewable by a user from an outside of the housing to display a fluid level in the associated secondary reservoir.

* * * * *